US008475104B2

(12) United States Patent
Mueller

(10) Patent No.: US 8,475,104 B2
(45) Date of Patent: Jul. 2, 2013

(54) BOOK PRODUCTION LINE FOR PRODUCING BOOKS COMPOSED OF BOOK BLOCKS INSERTED INTO A CASING

(75) Inventor: Hans Mueller, Lauda-Koenigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 342 days.

(21) Appl. No.: 12/793,082

(22) Filed: Jun. 3, 2010

(65) Prior Publication Data

US 2010/0310339 A1 Dec. 9, 2010

(30) Foreign Application Priority Data

Jun. 5, 2009 (EP) ..... 09405097

(51) Int. Cl.

| | |
|---|---|
| ***B42C 13/00*** | (2006.01) |
| ***B42C 11/02*** | (2006.01) |
| ***B42C 11/04*** | (2006.01) |
| ***B42C 5/02*** | (2006.01) |
| ***B42B 5/06*** | (2006.01) |
| ***B42B 5/04*** | (2006.01) |

(52) U.S. Cl.
USPC ..... 412/13; 412/19; 412/21; 412/30; 412/34; 412/36

(58) Field of Classification Search
USPC ..... 412/4, 5, 13, 19, 21, 30, 34, 36
See application file for complete search history.

(56) References Cited

U.S. PATENT DOCUMENTS

| | | | | |
|---|---|---|---|---|
| 5,874,812 | A | 2/1999 | Chang | |
| 6,250,868 | B1 * | 6/2001 | Schmucker | 412/13 |
| 6,352,252 | B1 * | 3/2002 | Schmucker et al. | 412/5 |
| 7,927,056 | B2 * | 4/2011 | Brommer | 412/21 |
| 2002/0061239 | A1 | 5/2002 | Bohn et al. | |
| 2003/0215309 | A1 * | 11/2003 | Engert et al. | 412/5 |
| 2009/0155022 | A1 * | 6/2009 | Garlichs et al. | 412/21 |

FOREIGN PATENT DOCUMENTS

| | | | |
|---|---|---|---|
| CH | 694 016 | A5 | 6/2004 |
| DE | 43 34 224 | A1 | 4/1995 |
| DE | 43 34 225 | A1 | 4/1995 |
| DE | 197 29 529 | A1 | 3/1998 |
| DE | 198 59 333 | A1 | 7/2000 |
| EP | 1 780 037 | A1 | 5/2007 |
| EP | 1 780 038 | A1 | 5/2007 |
| EP | 1 894 739 | A1 | 3/2008 |

OTHER PUBLICATIONS

Expanded European Search Report dated Nov. 20, 2009, issued in priority European Patent Application No. 09405097.8, and an English-language translation.

* cited by examiner

*Primary Examiner* — Dana Ross
*Assistant Examiner* — Kyle Grabowski
(74) *Attorney, Agent, or Firm* — Venable LLP; Robert Kinberg; Tamatane J. Aga

(57) ABSTRACT

A production line including a casing-in machine and a processing section upstream of the casing-in machine. The processing section includes processing stations arranged at clocking intervals along the processing section to process a book block spine. The processing section includes a first processing station group and a second processing station group. The production line further includes a conveyor to successively supply the book blocks in clocked operation to the processing stations. The conveyor includes a first conveying section assigned to the first processing station group, the first conveying section including a first individual drive, and a second conveying section assigned to the second processing station group, the second conveying section including a second individual drive. The production line further includes a control unit operatively connected to the first individual drive and second individual drive to change the clocking interval length along the processing section.

18 Claims, 2 Drawing Sheets

BOOK PRODUCTION LINE FOR PRODUCING BOOKS COMPOSED OF BOOK BLOCKS INSERTED INTO A CASING

CROSS-REFERENCE TO RELATED APPLICATION

This application claims the priority of the European Patent Application No. 09405097.8, filed on Jun. 5, 2009, the subject matter of which is incorporated herein by reference.

BACKGROUND

The invention relates to a production line for producing books comprising a book casing and a therein encased book block. The production line comprises a casing-in machine arranged at the conveying end of the production line, used for encasing a book block inside a book casing, and a processing section. The processing section comprises additional processing stations with processing devices assigned at partial distances or clocking intervals along the processing section. A book block can be advanced along the processing stations of the processing section for processing a book block spine. The processing stations comprise, in the conveying direction of the book blocks, a feed station for supplying the processing section with book blocks, a takeover station for taking over the book blocks, an adhesive-application station for spreading adhesive onto the book block spines, a backing station for attaching a backing strip and, if applicable, at least one headband, as well as a pressing station for pressing the backing strip or a headband against the book block spine, all arranged in the above sequence. The book blocks can be supplied successively and in a clocked manner to the processing stations with the aid of a conveyor and with the spines facing the processing devices.

For structural and arrangement reasons, the partial distances, also called the clocking intervals, between the processing stations are normally uniform along a conveying section for the takeover station, the following adhesive application station and the backing or headband-application station, but are farther apart by approximately 40 mm than the regular partial distances or clocking intervals for the conveying section assigned to the feed station.

Book production lines of this type are disclosed, among other things, in German patent document 43 34 224 A1, German patent document 43 34 225 A1, Swiss patent document 694 016 A5 and European patent document 1 894 739 A1.

With the disclosed book production lines, the conveying device and the processing stations are connected to a central drive motor. This arrangement requires a high driving power and results in high mass moments of inertia leading to the use of heavy gears and other involved drive elements. In recent years, the market for printed products, especially books, has shifted to extremely small editions of short-run productions for which the use of individual drives with angle of rotation controlled motors is suitable. Among other things, these motors offer the advantage that complete conveying sections can be stopped in case of a malfunction or that only the remaining production run can be processed out. Book blocks which are located downstream of the malfunction location on the production line can be processed further, meaning the portion of the production line that follows the malfunction can be emptied. As a result, waste material is noticeably reduced for very small editions, thus advantageously impacting the costs.

A traditional book production line normally comprises three conveying sections along a conveying line. The first conveying section is a feed or transfer section in which the book blocks are conveyed in a clocked manner, aligned and then transferred to the second conveying section for additional processing stations that follow in the downstream direction.

The second conveying section provides additional processing stations, as seen in the conveying direction, with a takeover station in which the book blocks are respectively positioned with the aid of a device on the feed section before being picked up by the movable chain mouth of side-by-side circulating chain conveyors that form the additional conveying section for the additional processing stations. The adhesive-application station, the backing station and the pressing station are located along this conveying section, as seen in conveying direction, wherein the adhesive is applied while a book block is moving through and after it is picked up by the chain conveyor, and wherein the subsequent backing and pressing operations occur successively while the book block is stopped.

The third conveying section is formed by the casing-in machine, in which six conveying elements circulate, for example in the form of a bucket conveyor.

The processing of small editions, for example involving 1 to 20 copies of book blocks of the same thickness, requires a relatively high share of the total expenditure for the set-up or conversion time. With traditional, standard book production lines, the requirements for producing a single-book edition can only be realized with difficulty and at high cost.

SUMMARY

It is an object of the present invention to create a book production line that makes possible a considerable improvement in the efficiency of the book production line when processing small editions of books having different thicknesses.

The above and other objects are accomplished according to one aspect of the invention wherein there is provided a production line for producing books including a book casing and a therein encased book block which, in one embodiment, includes a casing-in machine, arranged at a conveying end of the production line, to encase a book block in a book casing. The production line further includes a processing section upstream of the casing-in machine. The processing section includes processing stations arranged at clocking intervals along the processing section to process a book block spine. The processing stations include processing devices. The processing section includes, in sequence of the conveying direction of the book blocks, a first processing station group. The first processing station includes a feed station to supply book blocks to the processing section. The processing section further includes a second processing station group including, in sequence of a conveying direction of the book blocks, a transfer station to take over the book blocks, an adhesive-application station to apply adhesive to the book block spines, a backing station to attach a backing strip, and a pressing station to press the backing strip against the book block spine. The production line further includes a conveyor to successively supply the book blocks in clocked operation to the processing stations with the book block spines exposed and pointing upward toward the processing devices. The conveyor includes a first conveying section assigned to the first processing station group, the first conveying section including a first individual drive. The conveyor further includes a second conveying section assigned to the second processing station group, the second conveying section including a second individual drive. The production line further includes a control unit operatively connected to the first individual drive and second individual drive to change the clocking interval length along the processing section.

As a result, the length of the clocking intervals can be changed along the conveying section assigned to the processing stations.

A conveyor for the casing-in machine may be synchronously driven with the clocking rate of at least one of the conveying section for the feed station or the conveying section for the processing stations in order to coordinate the book production line.

The clocking interval length along the conveying section between the processing stations may be adjustable or re-adjustable to multiple lengths to achieve a higher performance efficiency.

With the herein described book production line, the clocking interval can be adjusted or re-adjusted to twice the length along the conveying section assigned to the processing stations, thereby avoiding any change in the coordination of the conveying sections.

Of course, it makes sense if the conveying sections for the processing stations and the feed station in which the book blocks are integrated into the process have approximately the same or different clocking interval lengths for large as well as small editions.

For the sake of simplicity, a multiple-length clocking interval on the conveying section assigned to the processing stations can be triggered via the control unit, based on a specific circulation number of uniformly thick book blocks.

The control unit may therefore be connected to a program and data memory for controlling the course of the processing of one or a plurality of successively following book block editions.

A change in the clocking interval length along the conveying section assigned to the processing stations to a clocking interval several times longer may occur for small editions ranging from one to five hundred book blocks so performance efficiency is improved.

The conveying section assigned to the processing stations of the processing section, arranged upstream of the casing-in machine as seen in book block conveying direction, may comprise alternately arranged processing stations designed for processing book blocks which are stopped or processing stations for processing book blocks that are moving through, to achieve a higher performance efficiency.

The end of the conveying section that is assigned to the processing stations in conveying direction of the book blocks, may therefore be a processing station which takes over the book blocks while the book blocks are stopped. The processing stations may then achieve a favorable clocking interval arrangement with an uneven clocking interval length between the conveying sections.

The book production line may be embodied so the conveying section that is assigned to the processing stations can be adjusted or re-adjusted during the processing of the book blocks.

It has proven useful if the individual drives for the conveying sections assigned to the processing stations and the feed station, respectively the casing-in machine, are provided with angle of rotation controlled electric motors, also called servo motors, which are operatively connected to the control unit, thus also resulting in an efficient structural design.

BRIEF DESCRIPTION OF THE DRAWINGS

The present invention will be more readily understood from the following detailed description when read in conjunction with the accompanying drawings, in which.

DETAILED DESCRIPTION

Figure 1:
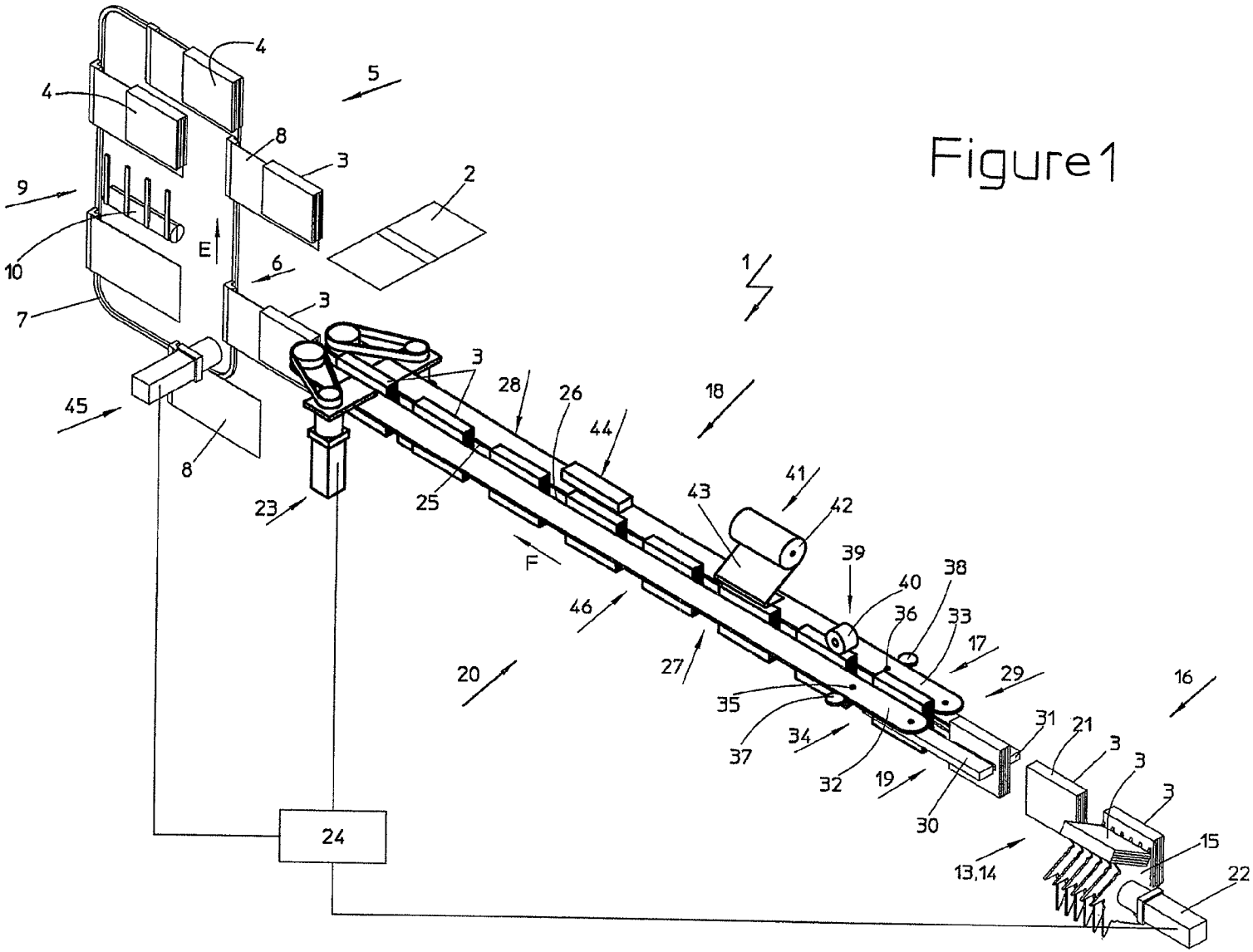
FIG. 1 A perspective view of a schematically shown book production line for the processing book blocks at clocked intervals along a processing section which ends in a casing-in machine.

FIG. 1 schematically shows a book production line 1 for producing books 4 comprising a book casing and a therein encased book block 3. The conveying end of the book production line 1 is formed by a processing station which is also referred to as casing-in machine 5 and is described, for example, in European patent documents 1 780 037 A1 and 1 780 038 A1, as well as in the German patent document 19729529, the disclosures of which are incorporated herein by reference.

The casing-in machine 5 is used for applying adhesive to the outside surfaces of the book block 3 and for pressing a book casing 2 against the adhesive-coated outside surfaces of a book block 3. For this, the casing-in machine is provided with a bucket-type conveyor 6, having a traction device that circulates in a vertical plane and thereto attached, jib-like extending saddle plates 8 for holding and transporting the book blocks 3 which are supplied by the processing section 20.

FIG. 1 furthermore shows the instantaneous position of six saddle plates 8 along the illustrated movement path where they have a nearly horizontal upper edge for accommodating the book blocks 3. The book blocks 3 are moved in the conveying direction F of the book blocks 3 along the processing section 20 and over a block divider (not shown herein) with the opened front, also called the fore edge, pointing downward. The block divider spreads out each book block 3 in the center so the book block 3 is in a position for takeover by the conveyor 6 in which the saddle plates 8 take over the book blocks by dipping from below into the slightly spread-out book blocks 3.

Following this, each book block 3 now straddling the saddle plates 8 moves vertically upward through an adhesive-application device, not shown herein, in which a book casing 2 supplied on the side of a pressing device (not visible herein) is pressed against the adhesive-coated outside surfaces of a book block 3, also called the fly leaves of a book block 3. Further along the conveying path of the casing-in machine 5, the just produced books 4 reach a delivery station 9 where they are taken over by a delivery element 10 and are deposited on a delivery belt, not shown herein.

Arranged upstream of the casing-in machine 5 is a processing section 20, along which additional processing stations are arranged at regular partial distances, also called clocking interval lengths. The processing stations include processing devices for processing a book block spine 21. As seen in conveying direction F for the book blocks 3, a feed station 13 with a feeding device 14 for supplying the following processing station is arranged at the start of the processing section 20.

Figure 2:
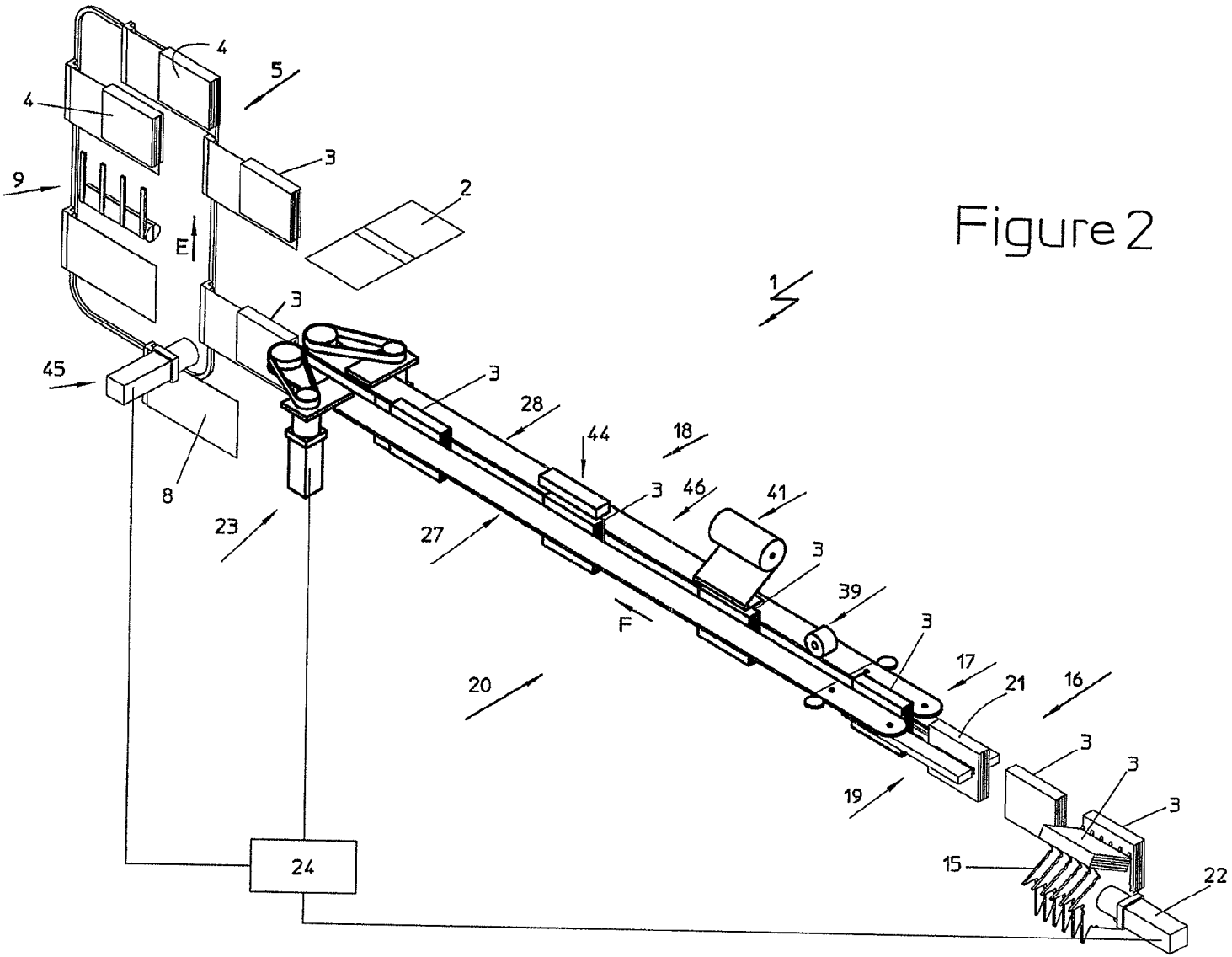
FIG. 2 The book production line according to FIG. 1 with multiple clocked interval processing along the processing section.

The clocked feeding of the book blocks 3 is realized, for example as shown in FIGS. 1 and 2, with the aid of a star rotor 15 driven around an axis extending parallel to the conveying direction F at the clocking rate of the conveying section 16 for the feed station 13. The star rotor 15 is provided along the circumference with six holding compartments for respectively supplying one book block 3 with its fore edge leading. The star rotor 15 deposits the book block 3 respectively with the fore edge onto a guide surface (not shown herein) where it is transported in synchronization with the clocking rate of the processing section 20 by a finger. The finger acts upon the rear edge of the book block and is positioned on a conveying chain (not visible) that is assigned to the feed station 13, respectively a feed device 14. The feed station 13, respectively the feed device 14, forms a separate feed section 16 which advances by several clocking intervals for transferring the book blocks 3 to the following processing station, a takeover station 17 of a conveying section 18 of the processing section 20, which follows in conveying direction F of the book blocks 3.

The separate conveying sections 16, 18 are provided with separate drives 22, 23 which are operatively connected to a joint control unit 24. The individual drives 22, 23 can be embodied as geared motors with an angle of rotation controlled electric motor and can be controlled individually or separately by the control unit 24. That is to say, the conveying sections 16, 18 can be operated with differently long clocking intervals. For the matter at hand, the conveying section 18, arranged downstream of the conveying section 16 for the feed station 13, as seen in conveying direction F of the book block 3, can be adjusted or re-adjusted to clocking intervals which are multiple times, for example two times, longer than is provided between the processing stations. A slight difference in the clocking interval length between the conveying sections 16 and 18, for example a clocking interval length that is longer by 40 mm in the conveying section 18 as compared to the conveying section 16, does not impact the functions or movements of the processing section 20.

To synchronize the clocking intervals over the complete book processing line 1, it may be useful if the conveyor 6 that is assigned to the casing-in machine 5 is synchronously operated with the clocked conveying speed of one of the two or both conveying sections 16, 18. The transfer of the book blocks 3 from the conveying section 16 to the conveying section 18 can be realized, for example, with a conveying clamp 19 as described in European patent document 09405082.0, the disclosure of which is incorporated herein by reference, which transfers the book block 3 over two clocking intervals to the conveying section 18. The conveying section 18, which is distinguished by the processing of a book block spine 21, is provided at the front end as seen in conveying direction F of the book blocks 3, respectively at the intake for the conveying section 18, with the aforementioned takeover station 17 in which the book blocks 3 are initially stopped until they are gripped on the conveying section 18.

This downstream arranged conveying section 18 of the conveyor assigned to the processing section 20 is formed by two conveying belt sections 25, 26, arranged on the side at a uniform distance to the longitudinal center axis that extends through the longitudinal center plane for the upright standing books blocks 3, of two adjacent and synchronously circulating conveying belts or conveying chains 27, 28, wherein the conveying belts 27, 28 are driven around the approximately vertical axes of deflection rollers that are not visible herein.

The intake region 29 of the conveying section 18, which is arranged upstream in conveying direction, projects counter to the conveying direction F over the transfer position for the conveying clamp 19, respectively the clamping jaws 30, 31 which form the conveying clamp, thus resulting in a super imposition of the conveying sections 16, 18. The intake region 29 forms a chain mouth 34 which is opened when a book block 3 is supplied with the aid of the conveying clamp 19 that is mounted on a sled or carriage. For this, the intake region 29 is expanded in a V shape to narrow down in a wedge-shaped taper in conveying direction F, thus ensuring a careful takeover of the book blocks 3 by the conveying section 18.

The opening and closing of the chain mouth 34 is achieved by pivoting to the side around vertical axes 35, 36 of the end sections 32, 33 that form the intake region of the conveying belts 27, 28, wherein the empty belt sections of the conveyor belts 27, 28 fit flush against side-mounted support rollers 37, 38. To change the conveying gap between the conveying belt sections or the working belt sections of the conveying belts 27, 28 for adapting these to the thickness of the book blocks, the latter can be adjusted or readjusted uniformly with respect to the mutual spacing.

The takeover station 17 is followed in conveying direction F of the book blocks 3, advanced by one clocking interval, by an adhesive application station 39 which is indicated by an adhesive roller 40. The latter is driven to roll off the book block spine 21 for applying the adhesive, such that the book block 3 passes through the adhesive application station 39 without stopping and is stopped only after the next clocking interval in the backing station 41, in which a backing material strip 43 is supplied from a roll 42 to the adhesive-coated book block spine 21. Following two more clocking intervals in conveying direction F, a pressing station 44 is arranged on the processing section 20 in which the backing material 43, placed onto the book block spine 21, is pressed against the adhesive-coated book block spine. The book blocks 3 reach the casing-in machine 5, respectively an available saddle plate 8, over the course of two or four clocking intervals following the pressing station 44. The conveying sections 16, 18, which function as a conveying device for the processing section 20, are driven separately with the aid of individual drives 22, 23 that are provided with angle of rotation controlled electric motors. The conveyor 6 of the casing-in machine 5 is also advantageously provided with a separate drive 45 which operates synchronized with the clocking rate of the at least one or both individual drives 22, 23 for the conveying sections 16, 18 via the joint control unit 24.

FIG. 2 shows the book production line 1 during the processing of book blocks 3, using a double clocking interval in conveying direction F between two processing stations 17, 41, 44, 5 in which a book block spine 21 is processed while the book block 3 is stopped. In particular small and extremely small editions make it possible to move with multiple or double clocking intervals along the conveying section 18 (as shown in the embodiment) over the processing section 20.

One difference lies in the manner in which the processing stations are arranged along the conveying section 18. An idle stroke step 46 may be provided between the backing station 41 and the pressing station 44 to obtain a double clocking interval along the conveying section 18, respectively a double stroke length for the clocking strokes.

With large editions, the resulting gap can be closed during normal operations by moving the pressing station 44 to be positioned downstream of the backing station 41, for example by having a mobile station, thereby closing the gap once more. The adhesive-application station 39 does not present an obstacle for a double clocking interval since adhesive is applied to the spine 21 of a book block while it is passing through.

It is understood that the above description of the present invention is susceptible to various modifications, changes and adaptations, and the same are intended to be comprehended within the meaning and range of equivalents of the appended claims.

What is claimed is:

1. A book production line to produce books comprising a book casing and a therein encased book block, the production line comprising:

a casing-in machine, arranged at a conveying end of the production line, to encase a book block in a book casing;

a processing section upstream of the casing-in machine, the processing section comprising processing stations arranged at clocking intervals along the processing section to process a book block spine, the processing stations comprising processing devices, the processing section comprising, in sequence of the conveying direction of the book blocks:

a first processing station group comprising:

a feed station to supply book blocks to the processing section; and a second processing station group comprising, in sequence of a conveying direction of the book blocks:

a transfer station to take over the book blocks;

an adhesive-application station to apply adhesive to the book block spines;

a backing station to attach a backing strip; and a pressing station to press the backing strip against the book block spine; and a conveyor to successively supply the book blocks in clocked operation to the processing stations with the book block spines exposed and pointing upward toward the processing devices, the conveyor comprising:

a first conveying section assigned to the first processing station group, the first conveying section comprising a first individual drive; and a second conveying section assigned to the second processing station group, the second conveying section comprising a second individual drive; and a control unit operatively connected to the first individual drive and second individual drive, the control unit configured to change the clocking interval length along the processing section based on controlling rotation of the first individual drive and the second individual drive.

2. The production line according to claim 1, wherein the individual drives comprise angle of rotation controlled motors.

3. The production line according to claim 1, further comprising a conveyor assigned to the casing-in machine driven in synchronization with the clocking interval length of at least one of the first conveying section or the second conveying section.

4. The production line according to claim 1, wherein the clocking interval length for the conveyor along the second conveying section is adjustable to be multiple times longer or the same length between the processing stations of the second processing station group.

5. The production line according to claim 4, wherein the clocking interval length for the second conveying section is adjustable to be twice as long.

6. The production line according claim 4, wherein the first and second conveying sections operate at clocking intervals having the same or different lengths.

7. The production line according claim 4, wherein a multiple times longer clocking interval length along the second conveying section is operable to be triggered by a specific edition size of book blocks with substantially the same thickness via the control unit.

8. The production line according to claim 7, wherein the control unit is connected to a program and data memory to control the course of the processing of a book block edition.

9. The production line according to claim 4, wherein the clocking interval length is changed along the second conveying section based on a specific edition size for the supplied book blocks with substantially the same book block thickness.

10. The production line according to claim 4, wherein the second conveying section is adjustable during the processing of the book blocks.

11. The production line according to claim 1, wherein the second conveying section of the processing section comprises at least one of:

a) alternately arranged processing stations to process at least one of stopped book blocks or to process book blocks that are passing through; or b) throughput stations.

12. The production line according to claim 11, wherein the front end of the second conveying section comprises a processing station to take over the stopped book block.

13. The production line according to claim 1, wherein the casing-in machine further comprises an individual drive, wherein the individual drives of the first conveying section, second conveying section, and the casing-in machine each comprise an angle of rotation controlled electric motor operatively connected to the control unit.

14. The production line according to claim 1, wherein the pressing station is arranged at a distance of multiple clocking interval lengths to the backing station.

15. The production line according claim 1, wherein the book blocks are transferred to the casing-in machine with a multiple-length clocking interval.

16. The production line according to claim 1, wherein the backing station further attaches a headband, wherein the pressing station further presses the headband against the book block spine.

17. The production line according to claim 1, wherein the clocking interval length comprises a distance between book blocks.

18. The production line according to claim 1, wherein the control unit is operable to change at least one of:

the clocking interval length of the first conveying section; or the clocking interval length of the second conveying section, so that the clocking interval length of the first conveying section and the clocking interval length of the second conveying section are different.

* * * * *